US009527556B2

(12) United States Patent
Skauen

(10) Patent No.: US 9,527,556 B2
(45) Date of Patent: Dec. 27, 2016

(54) STABILIZER FIN AND ACTIVE STABILIZER SYSTEM FOR A WATERCRAFT

(71) Applicant: Ronny Skauen, Fredrikstad (NO)

(72) Inventor: Ronny Skauen, Fredrikstad (NO)

( * ) Notice: Subject to any disclaimer, the term of this patent is extended or adjusted under 35 U.S.C. 154(b) by 0 days.

(21) Appl. No.: 14/438,133

(22) PCT Filed: Apr. 18, 2013

(86) PCT No.: PCT/NO2013/050067

§ 371 (c)(1),
(2) Date: Apr. 23, 2015

(87) PCT Pub. No.: WO2014/065672

PCT Pub. Date: May 1, 2014

(65) Prior Publication Data

US 2015/0259052 A1 Sep. 17, 2015

(51) Int. Cl.
*B63B 39/06* (2006.01)

(52) U.S. Cl.
CPC ..... *B63B 39/06* (2013.01); *B63B 2039/065* (2013.01)

(58) Field of Classification Search
CPC ..... B63B 35/71; B63B 35/79; B63B 41/00; B63B 39/06; B63B 39/061; B63B 2039/065; B63B 35/73; G05D 1/08; G05D 1/0875
USPC ..... 114/126; 441/79
See application file for complete search history.

(56) References Cited

U.S. PATENT DOCUMENTS

| | | | | |
|---|---|---|---|---|
| 2,223,562 | A | 12/1940 | Giliberty | |
| 3,169,501 | A * | 2/1965 | Wesner | G05D 1/0875 114/126 |
| 3,570,438 | A | 3/1971 | Mackowiak | |
| 4,811,674 | A * | 3/1989 | Stewart | B63B 35/7926 441/79 |
| 6,053,789 | A * | 4/2000 | Miyashiro | B63B 35/7926 441/79 |
| 6,213,044 | B1 * | 4/2001 | Rodgers | B63B 35/793 441/79 |
| 8,210,888 | B2 * | 7/2012 | Chambers | B63B 35/793 441/79 |
| 2003/0166365 | A1 * | 9/2003 | Redmon | B63B 35/7926 441/79 |
| 2007/0272143 | A1 | 11/2007 | Koop et al. | |

FOREIGN PATENT DOCUMENTS

| | | | |
|---|---|---|---|
| CH | 685 987 | A5 | 11/1995 |
| CN | 101879935 | A | 11/2010 |
| CN | 101992852 | A | 3/2011 |
| EP | 1 577 210 | A1 | 9/2005 |
| EP | 2 172 394 | A1 | 4/2010 |

(Continued)

*Primary Examiner* — Lars A Olson
(74) *Attorney, Agent, or Firm* — Birch, Stewart, Kolasch & Birch, LLP

(57) ABSTRACT

A stabilizer fin and an active stabilizer system for a watercraft with a hull includes a fin base arranged to be pivotally mounted to the hull with a pivot and to pivot about a pivot axis, a fin tip, a leading edge, and a trailing edge. A forward direction of the stabilizer fin is defined from the trailing edge to the leading edge at the fin base, and the trailing edge at the fin tip is bent away from a plane defined by the forward direction and the pivot axis, to give the trailing edge a concave profile in a lateral direction perpendicular to the plane.

20 Claims, 7 Drawing Sheets

(56) References Cited

FOREIGN PATENT DOCUMENTS

| | | | |
|---|---|---|---|
| EP | 2 277 771 | A1 | 1/2011 |
| FR | 2 878 502 | A1 | 6/2006 |
| GB | 999306 | | 7/1965 |

* cited by examiner

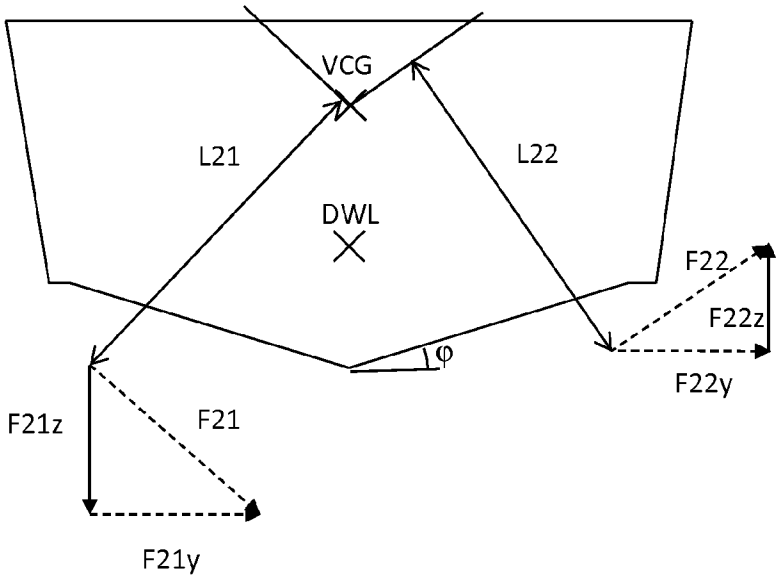
Fig. 4b
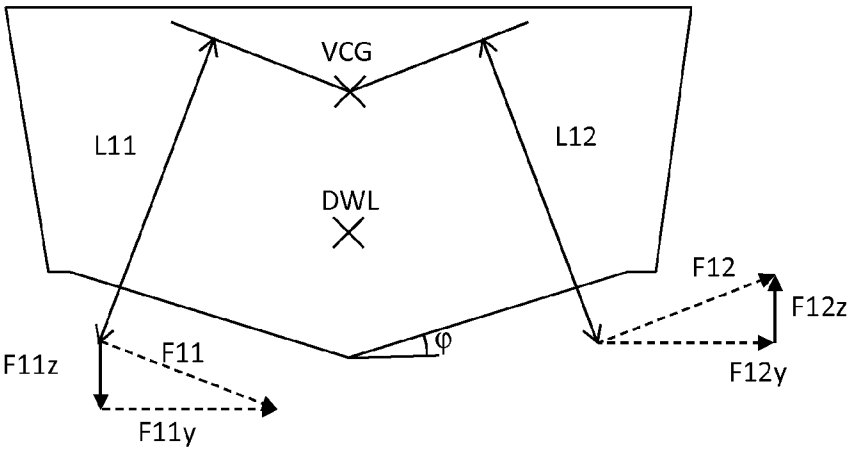
Fig. 4a (prior art)
Fig. 4

STABILIZER FIN AND ACTIVE STABILIZER SYSTEM FOR A WATERCRAFT

FIELD OF THE INVENTION

The present invention relates to the field of stabilizing a watercraft, primarily against roll that is unpleasant and at times unsafe for passengers and crew, but this invention also has improved capabilities for reducing sway and yaw consequences in comparison to traditional types of active fin stabilizer systems.

BACKGROUND ART

The art of reducing the unpleasant and at times dangerous roll motion of boats and ships in waves have evolved over many years, and there are many principle technologies used with varying benefits and results for different conditions, type of watercraft and not least cost of implementation and operation. Such different systems include fin stabilizers, gyro stabilizers and bilge tanks to mention the most common ones.

The traditional stabilization systems used in passenger vessels, naval vessels etc., were generally designed for use in underway situations and mostly for boats cruising in displacement mode and thereby in relatively low velocities. The watercraft that have traditionally been using stabilizers have also by their size and hull shapes generally had long roll times, thereby requiring relatively slow acting stabilization system, where counter forces are applied to the waves forces over relatively long time periods. Over the last 15 years, the market has evolved to where there is a requirement for also providing roll stabilization when the watercraft is at anchor, i.e. not having any forward motion, as well as stabilization systems being installed in much faster boats, including planning boats. These changes create many new challenges and issues, as explained below.

The first of the generally known issues is that with the watercraft not moving forward through the water, thus being able to make use of the forces in the waterflow passing the fins by the forward motion of the vessel to create a force to counter the waves forces that rolls the watercraft, the only way a fin stabilizer can apply a counter force, is to flap/swim the fins. This means that both the peak force possible as well as the time such a force can be applied is limited. The force is a result of the size of fin and the speed the fin is moved, and as an opposite, the faster the fin is moved, the shorter a time period the force can be applied as there is a limited physical movement of the fin, and it also has to be stopped without causing too much counter force in the undesired direction at the time. Mathematically or as a term in physics, the total force impulse is in principally determined by the fin size.

The second issue generally is the fact that modern faster watercrafts have a hull shape and a weight that makes their natural roll periods a lot shorter than the traditional vessels where stabilizers have been installed, and also that their physical requirement for stabilizer force is a higher factor compared to the boat size in comparison with the traditional watercraft equipped with stabilizers. The principal mathematical way to calculate the necessary force of a stabilizing system to reduce the roll by a desired amount is mostly based on a factor called Metacentric height (GM). This is a factor decided by how stiff the watercraft is on the water, i.e. the more it follows the waves angles, the more force is required from the stabilizer system to counter this roll, and what a stabilizer system actually does, is to force the boat to not follow the waves angle.

Given the fact that these modern vessels both require more force, while also allowing a shorter period to apply this force, it is apparent that these vessels are much more difficult to stabilize.

The simple solution is to install very big fins to be able to reach the desired roll reduction force, however this is not always a very good solution for several reasons, not least because very big fins cause a lot of drag through the water and thereby cause increased fuel consumption and reduced speed, more important on fast vessel given that drag as everything is a quadratic factor of velocity, ^2 so the impact becomes big on fast watercrafts. The physical sizes and power consumption of the actuating units required to run larger fins also create considerable problems as modern watercraft are designed with a high priority on available living space and cost efficiency.

As evidenced by other patents and work over the last years, much effort have been put into creating fins with low drag, and powering, systems that are as cost and energy efficient as possible.

However, a third issue that evidently have not been considered so much, but is an important benefit in this invention, is that by using very large traditional fins to reach the desired roll reduction forces, this will also have other impacts on the vessels, the faster and lighter the watercraft, the more negative these impacts become. A watercraft have 6 degrees of motion freedom in water, simply increasing the traditional force impulse will cause other negative effects on the watercraft by causing increased sway and yaw, both in underway and in at anchor situations which are then other, but still uncomfortable and negative effects on the boat.

At present, the overall market view is that fin stabilizers, even with the limitations of present fins, provide the overall best solutions as a single technology system to use for both underway and at anchor stabilization as most other solutions, like gyros or stabilization tanks, do not perform very well in underway situation of faster vessels. However, the problem of being able to apply enough force in at anchor situation, or at high speed with light weight vessels, without causing too many other negative implications on the watercraft in general still remains to be solved for fin stabilizers.

One solution to improve this situation is presented in patent US 2007/0272143/EP 1 577 210 that describes stabilizer fins that have the ability to change its size and shape to thereby have different size in underway and at anchor situations, increasing the possible force without causing additional drag when not needed.

European patent application EP1577210A1, describes an active roll stabilization system comprising fins with a sub-elements, where the sub elements are movable, i.e. linked with respect to the fins.

Other known solutions are retractable stabilizer fins that are only deployed into the water when needed, thereby creating no drag when not needed.

Both of these solutions are rarely used in watercraft with limited installation space and budgets due to their complexity, internal space requirements and cost.

There are also many other patents and patent applications for various means and methods to increase the efficiency of fin stabilizers, most of these relate to various types of drive mechanism or control algorithms and are thereby unrelated to the invention.

SHORT SUMMARY OF THE INVENTION

An object of the present invention is to disclose an active stabilizer system for a watercraft that is more efficient than prior art.

One of the problems with prior art technology is that active roll stabilizers may cause the watercraft to sway or yaw due to the large forces applied on the stabilizers, and thereby creates another unpleasant movement for the passengers, as described prevously.

It is therefore an object of the invention to disclose an active stabilizer system that is able to stabilize the roll movement of the watercraft at anchor and in motion without introducing other unpleasant movements of the watercraft.

A challenge related to anti-roll stabilizer systems design, is that the fins should not extend outside the hull in a lateral direction. Many boats, and especially boats for leisure has a flat, V-shaped hull, and this means that the fins have to be located under the flat part, which gives little freedom for different fin movements.

The problem of being able to apply enough roll reduction force by an active fin stabilizer system to significantly reduce the wave induced rolling motion of a watercraft while keeping negative effects such as increased fuel consumption, reduced speed, direct energy consumption of the stabilizer system, space consumption inside the vessel, initial investment cost, operation and maintenance cost and causing other unpleasant movements of the watercraft to a minimum, has been solved by the invention.

The disclosed solution herein propose to use a fin design that change the direction of the force created by the stabilizer fins, both in underway as well as at anchor situations, so that the resulting forces are directed more in the desired direction than prior art systems, to counteract roll only. Since the direction of the applied forces are more ideal for the intended task, the fins can be smaller in size, causing less drag, have the same roll reduction force with a considerably smaller direct power consumption and be able to apply more force in the desired direction with less force applied in an undesired direction, and thereby also causing less unwanted other movements of the watercraft.

Independent analysis based on mathematical models have shown that the novel and inventive shape of the stabilizer fin according to the invention solves the problems outlined above. The invention is therefore, in an embodiment of the invention, a stabilizer fin for a watercraft with a hull, wherein the stabilizer fin comprises;

a fin base (11) arranged to be pivotally mounted to the hull with pivot means (20) so that said stabilizer fin (10) can pivot about a pivot axis (p), a fin tip (30), a leading edge (12), and a trailing edge (13), wherein a forward direction (f) of the stabilizer fin (10) is defined from the trailing edge (13) to the leading edge (12) at the fin base (11), and wherein the trailing edge (13) at the fin tip (30) is bent away from a plane (15) defined by the forward direction (f) and the pivot axis (p), to give the trailing edge (13) a concave profile in a lateral direction (ld) perpendicular to the plane (15).

In an embodiment the invention is also an active fin stabilizer system for a watercraft with a hull with a centerline, wherein the active fin stabilizer system comprises;

a first stabilizer fin (10) according to claim 1 with first pivot means arranged to be mounted to the hull (2) on a port side of the centerline, a second stabilizer fin (10) according to claim 1 with second pivot means arranged to be mounted to the hull (2) on a starboard side of the centerline, wherein the fin tips (30) of the first and second stabilizer fins (10, 10) are bent in opposite lateral directions away from the centerline, the first and second pivot means (20) arranged to pivot the first stabilizer fin (10) and the second stabilizer fin (10) respectively, a roll sensor (60), and a control system (70), wherein the control system is arranged for receiving roll indication sensor signals from the roll sensor (60), and further arranged for sending control signals to the first and a second pivot means (20) to pivot the first and second stabilizer fins (10) to counteract roll of the watercraft.

The invention, thus provides a significantly increased roll reduction force compared to the fin size, energy consumption, technical complexity, negative ship motion impacts and cost on a basic level, totally independent of the actuating technology that is used. I.e. it provides the same benefits for all drive technologies.

FIGURE CAPTIONS

The attached figures illustrate some embodiments of the claimed invention.

FIG. 4 illustrates resulting momentum on a boat with fins according to prior art in FIG. 4*a*, and according to the invention in FIG. 4*b*.

EMBODIMENTS OF THE INVENTION

The invention will in the following be described and embodiments of the invention will be explained with reference to the accompanying drawings.

To ease the understand of the drawings, the front or the leading edge of the fin has been marked with a black dot. This marking is not in any other way related to the invention.

Figure 1:
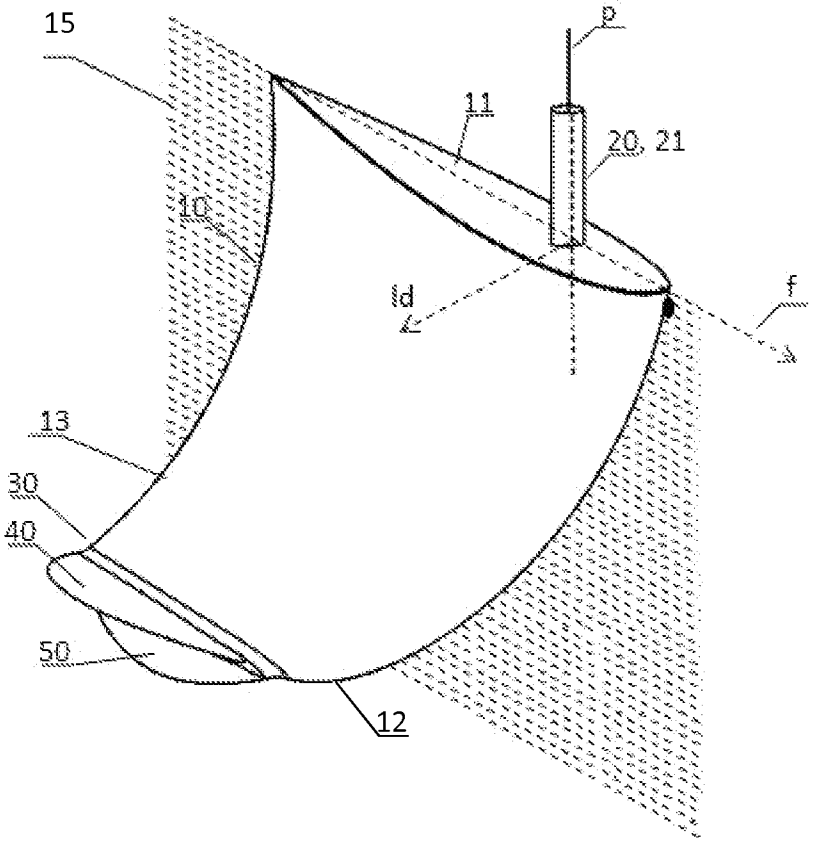
FIG. 1 is an isometric view of a stabilizer fin according to the invention

FIG. 1 illustrates a stabilizer fin according to an embodiment of the invention.

In this embodiment the stabilizer fin comprises;

a fin base (11) arranged to be pivotally mounted to the hull with pivot means (20)

so that said stabilizer fin (10) can pivot about a pivot axis (p), a fin tip (30), a leading edge (12), and a trailing edge (13), wherein a forward direction (f) of the stabilizer fin (10) is defined from the trailing edge (13) to the leading edge (12) at the fin base (11), and wherein the trailing edge (13) at the fin tip (30) is bent away from a plane (15) defined by the forward direction (f) and the pivot axis (p), to give the trailing edge (13) a concave profile in a lateral direction (Id) perpendicular to the plane (15).

It should be noted that the plane (15) illustrated in FIG. 1 that defines the directions of the fin according to the invention, also may represent the direction of fins according to prior art, where the prior art fin body would typically lie in the plane (15).

In an embodiment the pivot axis (p) is orthogonal to the fin base (11).

Different types of bent profiles can be used to improve the anti-roll forces, such as a profile with one or more discrete bends or a smooth curved profile. According to an embodiment the concave profile of the trailing edge (13) is curved.

According to an embodiment the trailing edge (13) at the fin tip (30) is bent away from the plane (15) at least 15 degree from the trailing edge (13) at the fin base (11).

According to an embodiment the trailing edge (13) at the fin tip (30) is bent away from the plane (15) at least 20 degree from the trailing edge (13) at the fin base (11).

FIGS. 2*a*, 2*b* and 2*c* shows how such a fin can be designed for mounting under the port side of the hull. The stabilizer fin is shown in three different positions, all seen from the front. In FIG. 2*b* the fin is in a neutral position, i.e. a position where the fin would not provide any anti-roll forces when the watercraft is not rolling in steady water. FIG. 2*a* shows the fin pivoted with the rear part towards the centerline of the boat, and FIG. 2*c* shows the fin pivoted in the opposite direction with the rear part towards the starboard of the boat.

The fin according to the invention is a hydrodynamically perfected foil, shaped so that its resulting force when being rotated in the water flow or rotated fast in a swimming motion will cause a resulting force vector that is larger in the anti-roll direction and smaller in the lateral direction, i.e. the yaw and sway direction compared to prior art fins. The fin is also shaped to reduce drag while being able to increasing force.

The current invention solves the problem remaining in prior art, i.e., where to install the fins so that they only apply force directly and only in the desired direction to counter roll. Fins according to prior art apply their force in a direction parallel direction to the hull angle where they are installed. This is then transformed into a roll force by the force being seen as acting around the boats centre of gravity of which it is mathematically considered to roll, where the centre of gravity can be thought of as a bearing. However, since the boat is floating in water, the centre of gravity is not actually a fixed bearing point, it only acts as a bearing within the limitation of its inertia in the directions we do not want it to move, like sway and yaw movements. Practically speaking the issue is a matter of the boats inertia in the undesired movement directions is a clear limiting factor to the total force impulse you can apply, hence just increasing the force in an imperfect direction will not solve the complete issue and require more of a compromise in what level you can practically apply to counter the roll without other negative effects, especially in modern, light weight watercraft. At the same time, the present invention will also improve the efficiency in more traditional heavier vessels where the potential of yaw and sway is not so dominant due to their higher inertia levels.

Figure 2:
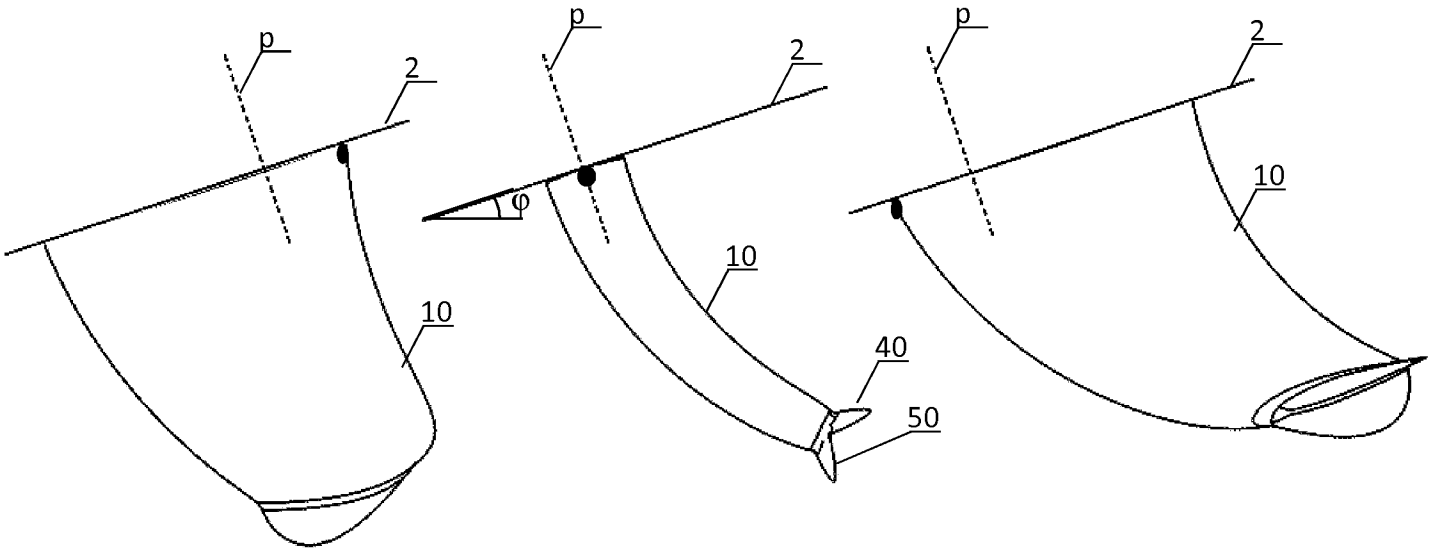
FIG. 2 illustrates a stabilizer fin according to an embodiment of the invention pivoting about a pivot axis (p) in three different positions.

FIG. 2 illustrates a fin (10) according to an embodiment of the invention seen from the front, and mounted under the port side of a hull (2) with a deadrise (9). The middle drawing shows the fin (10) in a neutral position, i.e. not applying any forces in the roll direction if the water is smooth and the boat is not rolling.

The drawing to the left shows the fin (10) in a position where the back of the fin has been forced towards the centerline of the boat, and the drawing to the right shows the fin (10) in a position where the back of the fin has been forced from the centerline of the boat. When the fin is moving towards the centerline, the side of the boat where the fin is located will be lifted, while it will be lowered when the fin is moving towards the side of the boat.

Figure 3:
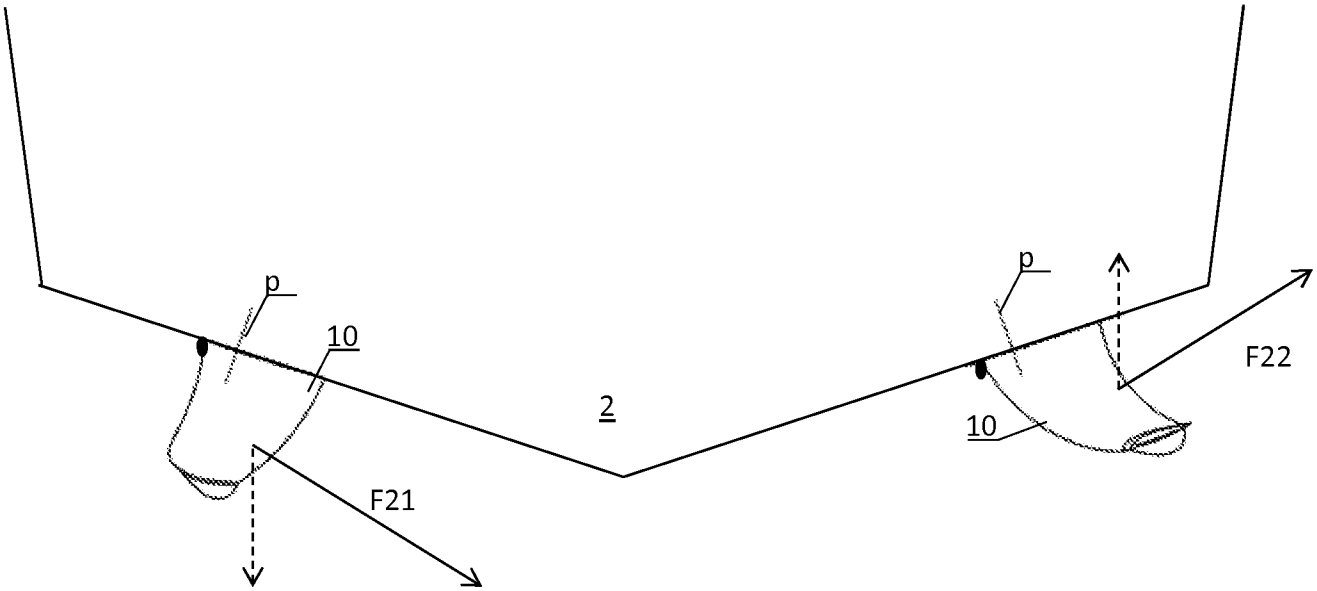
FIG. 3 illustrates two stabilizer fins according to an embodiment of the invention mounted to a hull of a boat.
Figure 5:
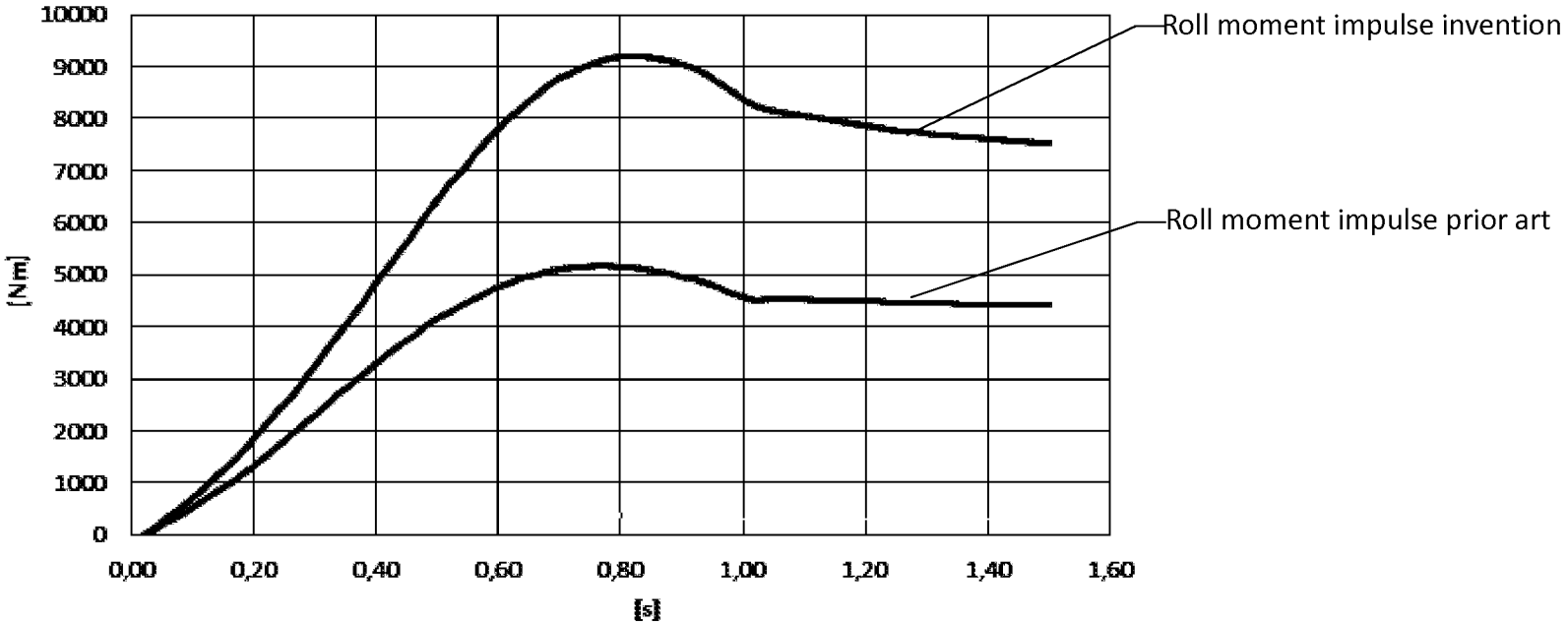
FIG. 5 Shows in a graph the improved impulse momentum in the roll direction compared to prior art.

FIG. 3 shows an example of a boat with two fins mounted to the hull (2), one of each side of the centerline. In this figure the fins are illustrated in a pivoted position to counteract a roll movement. The forces (F21, F22) illustrate the resulting forces from the fin motion acting on the boat. The anti-roll forces are the vertical component of the forces, illustrated as dashed arrows.

The efficiency improvement of anti-roll stabilization has been verified by mathematical models and simulations of the system that show a considerable change compared to traditional active stabilizer fins with a straight body.

In FIG. 4 the results of the simulations for a specific example boat is shown. The boat is a 56 feet flybridge boat with a deadrise (9) of 16.5°. Further the height from the baseline to the Design Waterline (DWL) is 0.86 m and from the design waterline to the vertical centre of gravity (VCG) 0.99 m.

The two fin designs require in total the same force applied from the two actuators acting on the fins.

The forces acting on the boat when the fins are activated depends on the torque applied to the fin, and the length of the lever arm. In the following description, the starboard is to the right in the drawings.

In FIG. 4*a* the resulting forces acting on the boat when traditional straight stabilizer fins according to prior art are used, while in FIG. 4*b* the forces resulting from the improved stabilizer fin according to prior art is shown.

In FIG. 4*a*, the lever arm (L11, L12) is the same on the starboard and the port side, in this case 2.27 m, since the straight fins are symmetric about the centerline also when actuated. The resulting net force (F11, F12) on each fin is 1325N. This gives a torque of 6015Nm.

In FIG. 4*b* the starboard and port fins will be assymetric when actuated as seen in FIG. 3, and the lever arms on the two sides will be different. The port lever arm (L21) is 2.55 m and the starboard lever arm (L22) is 2.49 m. The resulting net port and starboard forces (F21, F22) on each fin is 1610N and 1310N, respectively.

This gives a torque of 7396Nm. The total improvent in the roll torque is 23% in this case. The same model will also show that the lateral forces acting on the boat has been reduced with 8%.

When decomposing the force vectors (F11, F12) of FIG. 4*a*, and the force vectors (F21, F22) of FIG. 4*b*, it is evident that the forces in the roll direction have increased considerably, and that the forces in the yaw and sway direction has been reduced.

When the boat is at anchor, there is little or no drag or lift on the stabilizer fin that can be used for counteracting roll movements. In this case the fins have to stabilize the boat by simply lifting water up on one side and pressing water down on the other side, and these anti-roll movements have to take place instantly to prevent roll.

In this mode the improved efficiency of the stabilizer fins according to the invention is even larger than in the cruising mode. For the same 56 feet flybridge boat as described above, the impulse roll moment has been compared to prior art with straight fins and the results are summarized in FIG.

5, where it can be seen that the roll moment is considerably better for the invention than for prior art for impulse anti-roll movements.

According to an embodiment of the invention the cross section of the stabilizer fin (10) has a NACA profile. According to an embodiment the profile is asymmetric with a larger camber on the concave side than on the convex side. This compensates for the smaller concave surface that would else give a drag, or lift on the other side of the stabilizer fin.

A further advantageous effect can be obtained by providing the stabilizer fin with winglets at the fin tip. Winglets are known from prior art, where they are extending orthogonally from the fin tip. However, according to an embodiment of the invention, the stabilizer fin stabilizer comprises a first auxiliary fin (40) extending from the fin tip (30) in the lateral direction (ld), which improves the anti-roll properties of the fin, without creating unwanted cavitation.

According to an embodiment the stabilizer fin comprises a first auxiliary fin (40) extending from the fin tip (30), parallel to the fin base (11) in the lateral direction (ld). This is illustrated in FIG. 1, and in the middle drawing of FIG. 2. The first auxiliary fin (40) will then direct the force when turned or swam to a direction that is not in parallel with the surface of the hull. In an embodiment the fin (10) comprises a second auxiliary fin (50) extending from the fin tip (30), wherein the second auxiliary fin (50) extends in a direction orthogonal to the fin base (11). Like for the first auxiliary fin (40), the second auxiliary fin will also contribute to the anti-roll properties of the fin, without creating unwanted cavitation. The stabilizer fin may comprise only the first auxiliary fin (40), only the second auxiliary fin (50), or both auxiliary fins.

Figure 6:
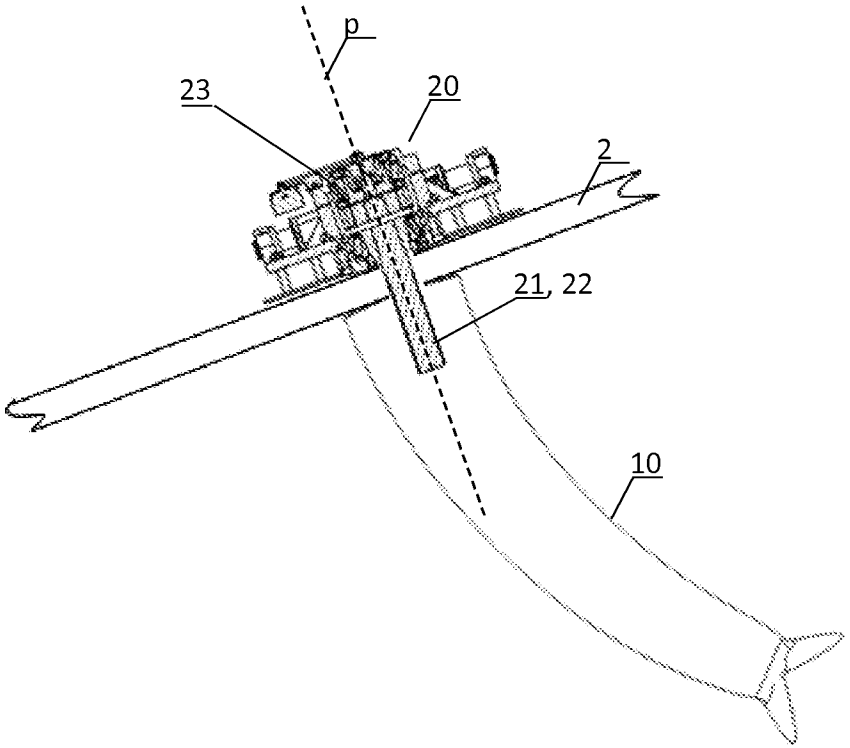
FIG. 6 illustrates a stabilizer fin mounted under the hull of a boat, and an actuator inside the boat.

FIG. 6 shows an embodiment of the pivot means (20) where the fin (2) is seen pivotally mounted to the hull (2) with the pivot means (20). In this embodiment the fin has a hole (22) from the baseline into the fin. The direction and center of the hole is in the direction and center of the pivot axis (p) respectively. An actuator axle (21) is fixed in the hole, by e.g. glue or alternative fastening means, and extends up through a penetration in the hull (2). On the inside of the hull (2), an actuator module (23) is fastened to the hull (2), and the actuator module is arranged to receive and fasten the actuator axle (21) to prevent it from falling off. The actuator module (23) is a two way actuator arranged to displace the actuator axle (21) in an angular direction to make the fin (10) pivot about the pivot axis (p) when operated.

The actuator module (23) can be driven by a multitude of direct and indirect power sources such as hydraulic cylinders, electro mechanic actuators, electric motors of any kind, mechanical link arm assemblies or similar through a shaft or other suitable direct attachment method.

In an embodiment of the invention, the bearing and actuating assembly has a mechanical design that changes the angle of the shaft or other suitable attachment method of the mentioned new fin design or a traditional straight fin design to achieve the same changed force direction, either generally at all times, or in fact as an adjustable angle for one time setup or as a variable function depending on the usage condition at the time, for example only in at anchor situation.

Figure 7:
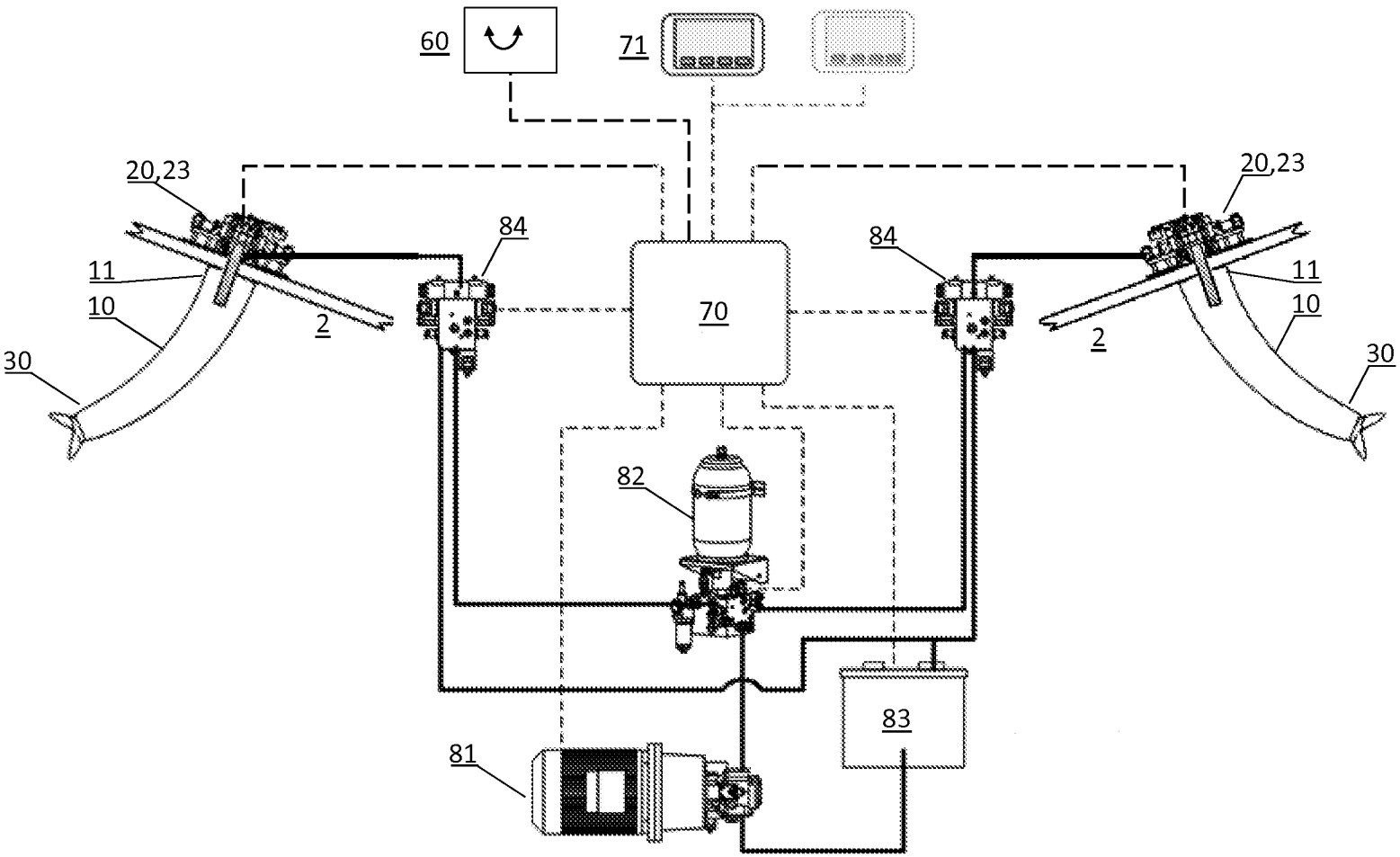
FIG. 7 illustrates an active fin stabilizer system according to an embodiment of the invention.

FIG. 7 shows a block diagram of an active fin stabilizer system according to an embodiment of the invention.

Port and starboard portions of the hull (2) with respective stabilizer fins (10) and pivot means (20) comprising actuators (23) are illustrated to the left and right in the figure. The centerline of the hull is not illustrated, but would be located between the hull portions (2) in a real system. According to the invention the fin tips (30) are bent or curved in opposite directions away from the centerline.

In this embodiment the invention is an active fin stabilizer system for a watercraft with a hull (2) with a centerline, wherein the active fin stabilizer system comprises;

a first stabilizer fin (10) according to claim 1 with first pivot means arranged to be mounted to the hull (2) on a port side of the centerline, a second stabilizer fin (10) according to claim 1 with second pivot means arranged to be mounted to the hull (2) on a starboard side of the centerline, wherein the fin tips (30) of the first and second stabilizer fins (10, 10) are bent in opposite lateral directions away from the centerline, the first and second pivot means (20) arranged to pivot the first stabilizer fin (10) and the second stabilizer fin (10) respectively, a roll sensor (60), and a control system (70), wherein the control system is arranged for receiving roll indication sensor signals from the roll sensor (60), and further arranged for sending control signals to the first and a second pivot means (20) to pivot the first and second stabilizer fins (10) to counteract roll of the watercraft.

In FIG. 7 the dashed lines represent electrical connections, while solid lines represent hydraulic connections.

The other components illustrated in the figure, is a hydraulic pump (81).

This can be an electric driven hydraulic powerpack or any other suitable pump.

In addition a hydraulic tank (83), hydraulic accumulator (82) and valve units (84) are common components of a hydraulic system.

The illustration in FIG. 7 is just one example of how to implement an active stabilizer system according to the invention. In other implementations there could e.g. be one pump for each stabilizer fin, electric actuators etc.

The roll sensor (60) sends a roll signal to the control system (70) that will open and close the valve units (84) depending on the current roll.

One or more control panels (71) may be used for setting the anti-roll parameters, e.g. turning anti roll on and off, and to present roll parameters to the operator.

According to an embodiment of the invention, the control system is arranged for sending control signals to the first and a second pivot means (20) to pivot the first and second stabilizer fins (10) simultaneously in the same lateral direction (ld).

The system according to the invention may comprise more than two stabilizer fins. Preferably the number of fins is even, e.g. 2, 4 etc. . . . According to an embodiment of the invention the active fin stabilizer system comprises;

a third stabilizer fin (10) according to claim 1 arranged to be mounted to the hull (2) on a port side of the centerline, a fourth stabilizer fin (10) according to claim 1 arranged to be mounted to the hull (2) on a starboard side of the centerline, wherein the fin tips (30) of the third and fourth stabilizer fins (10, 10) are bent in opposite lateral directions away from the centerline, a third and a fourth pivot means (20) according to claim 5 arranged to pivot the third stabilizer fin (10) and the fourth stabilizer fin (10) respectively, wherein the first and second stabilizer fins (10, 10) are arranged for being mounted at a first distance from a stern of the watercraft, and the third and fourth stabilizer fins (10, 10) are arranged for being mounted at a second distance from a stern of the watercraft.

According to an embodiment the pairs of stabilizer fins can be operated independently, i.e. a first pair comprising first and second stabilizer fins (10) and a second pair comprising third and fourth stabilizer fins (10). This can be advantageous when the boat operates in different modes, such as cruising and at anchor. In an embodiment the fore pair of stabilizers operates only at anchor, while the aft pair operates both at anchor and in cruising modes.

The invention claimed is:

1. A stabilizer fin for a watercraft with a hull, wherein said stabilizer fin comprises:

a fin base arranged to be pivotally mounted to said hull with a pivot so that said stabilizer fin can pivot about a pivot axis;

a fin tip;

a leading edge; and a trailing edge, wherein a forward direction of said stabilizer fin is defined from said trailing edge to said leading edge at said fin base, and wherein said trailing edge at said fin tip is bent away from a plane defined by said forward direction and said pivot axis, to give the trailing edge a concave profile in a lateral direction perpendicular to said plane.

2. The stabilizer fin according to claim 1, wherein a cross section of said stabilizer fin has a NACA profile.

3. The stabilizer fin according to claim 1, wherein said pivot axis is orthogonal to said fin base.

4. The stabilizer fin according to claim 1, wherein said concave profile of said trailing edge is curved.

5. The stabilizer fin according to claim 1, wherein said trailing edge at said fin tip is bent away from said plane at least 15 degree from said trailing edge at said fin base.

6. The stabilizer fin according to claim 1, further comprising a first auxiliary fin extending from said fin tip, parallel to said fin base in said lateral direction.

7. The stabilizer fin according to claim 6, further comprising a second auxiliary fin extending from said fin tip, wherein said second auxiliary fin extends in a direction orthogonal to said fin base.

8. The stabilizer fin according to claim 1, wherein said pivot further comprises:

an actuator axle arranged to be fixed to said fin base and extending from said fin base in the direction of said pivot axis; and an actuator arranged to be fixed inside said hull, and further arranged to receive and fasten said actuator axle through a hole in said hull.

9. An active fin stabilizer system for a watercraft with a hull with a centerline, wherein said active fin stabilizer system comprises:

a first stabilizer fin according to claim 1 with a first pivot arranged to be mounted to said hull on a port side of said centerline;

a second stabilizer fin according to claim 1 with a second pivot arranged to be mounted to said hull on a starboard side of said centerline, wherein said fin tips of said first and second stabilizer fins are bent in opposite lateral directions away from said centerline, wherein said first and second pivots are arranged to pivot said first stabilizer fin and said second stabilizer fin, respectively;

a roll sensor; and a control system, wherein said control system is arranged for receiving roll indication sensor signals from said roll sensor, and further arranged for sending control signals to said first and a second pivots to pivot said first and second stabilizer fins to counteract roll of said watercraft.

10. The active fin stabilizer system according to claim 9, wherein said control system is arranged for sending control signals to said first and second pivots to pivot said first and second stabilizer fins simultaneously in the same lateral direction.

11. The active fin stabilizer system according to claim 9, further comprising:

a third stabilizer fin according to claim 1 arranged to be mounted to said hull on a port side of said centerline;

a fourth stabilizer fin according to claim 1 arranged to be mounted to said hull on a starboard side of said centerline, wherein said fin tips of said third and fourth stabilizer fins are bent in opposite lateral directions away from said centerline; and a third and a fourth pivot arranged to pivot said third stabilizer fin and said fourth stabilizer fin, respectively, wherein the trailing edge at the fin tip of the third and fourth pivots are bent away from the plane at least 15 degree from the trailing edge at the fin base, wherein said first and second stabilizer fins are arranged for being mounted at a first distance from a stern of said watercraft, and said third and fourth stabilizer fins are arranged for being mounted at a second distance from a stern of said watercraft.

12. The active fin stabilizer system according to claim 11, wherein said control system is arranged to operate said first and second stabilizer fins independently from said third and fourth stabilizer fins.

13. The stabilizer fin according to claim 2, wherein said pivot axis is orthogonal to said fin base.

14. The stabilizer fin according to claim 2, wherein said concave profile of said trailing edge is curved.

15. The stabilizer fin according to claim 3, wherein said concave profile of said trailing edge is curved.

16. The stabilizer fin according to claim 2, wherein said trailing edge at said fin tip is bent away from said plane at least 15 degree from said trailing edge at said fin base.

17. The stabilizer fin according to claim 2, comprising a first auxiliary fin extending from said fin tip, parallel to said fin base in said lateral direction.

18. The stabilizer fin according to claim 3, comprising a first auxiliary fin extending from said fin tip, parallel to said fin base in said lateral direction.

19. A stabilizer fin for a watercraft with a hull, said stabilizer fin comprising:

a fin base arranged to be pivotally mounted to said hull with a pivot so that said stabilizer fin can pivot about a pivot axis;

a fin tip;

a leading edge;

a trailing edge;

a first lateral side extending between the leading edge and the trailing edge; and a second lateral edge opposite the first lateral side and extending between the leading edge and the trailing edge;

wherein a forward direction of said stabilizer fin is defined from said trailing edge to said leading edge at said fin base, wherein the first lateral side of the fin is concave extending in a direction from the fin base to the fin tip and the second lateral side of the fin is convex in the direction from the fin base to the fin tip.

20. The stabilizer fin according to claim 19, wherein the trailing edge is concave extending in the direction from the fin base to the fin tip.

* * * * *